US005332596A

United States Patent [19]

Tani et al.

[11] Patent Number: 5,332,596

[45] Date of Patent: Jul. 26, 1994

[54] METHOD FOR ANTI-OXIDIZING TREATMENT OF COPPER POWDER

[75] Inventors: Hiroji Tani, Nagaokakyo; Kanehito Honma, Shiga, both of Japan

[73] Assignee: Murata Mfg. Co., Ltd., Japan

[21] Appl. No.: 6,266

[22] Filed: Jan. 19, 1993

[30] Foreign Application Priority Data

Jan. 17, 1992 [JP] Japan ..... 4-006535

[51] Int. Cl.[5] ..... B05D 7/00

[52] U.S. Cl. ..... 427/216; 427/215; 427/376.1

[58] Field of Search ..... 427/216, 215, 376.1

[56] References Cited

U.S. PATENT DOCUMENTS 4,439,382 3/1984 Joó et al. ..... 427/226

4,600,604 7/1986 Sinta ..... 427/216

OTHER PUBLICATIONS

"CRC Handbook of Chemistry & Physics", 60th Ed., editor, Weast, R. C., pp. D-67, D-69.

*Primary Examiner*—Shrive Beck
*Assistant Examiner*—David M. Maiorana
*Attorney, Agent, or Firm*—Ostrolenk, Faber, Gerb & Soffen

[57] ABSTRACT

Anti-oxidizing treatment of copper power is carried out by immersing copper powder in a solution containing boric acid, separating the resultant copper powder from the solution, and heating the copper powder covered with a thin layer of the solution at a temperature of 50° to 260° C.

7 Claims, No Drawings

METHOD FOR ANTI-OXIDIZING TREATMENT OF COPPER POWDER

BACKGROUND OF THE INVENTION

1. Field of the Invention

The present invention relates to a method for an anti-oxidizing treatment of copper powder and, more particularly, a method for producing non-oxidizable copper powder useful as a conductive material for circuit patterns of electronic devices.

2. Description of the Prior Art

In electronic parts such as monolithic ceramic capacitors, surface acoustic wave filters and the like, it is custom to use a conductive paste to form conductive patterns of a circuit. For example, internal electrodes of monolithic ceramic capacitors are formed by applying a conductive paste on ceramic sheets by coating or printing, drying the printed sheets, and firing them in an inert atmosphere such as nitrogen atmosphere.

Such a conductive paste is generally prepared by dispersing powder of copper in an organic vehicle together with glass frit. It is very important for the conductive paste to use copper powder free from oxidation as well as to prevent it from oxidation since the oxidation of the copper powder lowers the printing property of the paste and the solderability of the produced circuit patterns and increases the sheet resistivity of produced circuit patterns. To this end, it is general practice to fire the ceramic sheets with circuit patterns of the conductive paste in an inert atmosphere to prevent copper powder from oxidation. However, the use of the inert atmosphere limits the organic vehicles that can be used for the conductive paste since it is necessary to burn out the organic vehicle during firing.

In order to burn out the vehicle, the firing atmosphere is occasionally provided with oxygen in an amount of the order of several ten to several hundreds ppm. In such a case, however, it is not possible to protect copper powder from oxidation.

In addition, since the copper powder, when being placed in air, is oxidized gradually, special care is required for storage of the copper powder. Thus, it is very troublesome to handle the copper powder.

SUMMARY OF THE INVENTION

The present invention has been made to overcome the aforesaid disadvantages and a main object of the present invention is to provide a method of anti-oxidizing treatment of copper powder that makes it possible to produce copper powder which is protected from oxidation even when left in air for a long period of time or even when fired in an inert atmosphere containing oxygen incorporated therein.

The above and other objects of the present invention are solved by a method which includes immersing copper powder in a solution containing boric acid, separating it from the solution, and then heating it at a temperature of 50° to 260° C.

As a copper powder, it is preferred to use a powder of copper which is free from oxidation and has particle size of 0.1 to 5 μm.

As a solvent for boric acid, there may be used those such as alcohols, polyols and their derivatives, and other organic compounds having one or more hydroxy groups in molecules thereof. Typical alcohols include, without being limited to, methanol, ethanol, butyl alcohol, isopropyl alcohol and the like. It is however preferred to use lower alcohols having not more than 10 carbon atoms. Also, typical polyols and their derivatives include, without being limited to, ethylene glycol, ethylene glycol monoalkyl ethers such as ethylene glycol monomethyl ether, ethylene glycol monoethyl ether, ethylene glycol monoisobutyl ether, ethylene glycol monooctyl ether, ethylene glycol monobutyl ether and the like. The above solvents may be used alone or in combination as occasion demands.

According to the present invention, copper powder is firstly immersed and held in a boric acid solution for a certain period of time, for example, 0.1 to 10 hours, with stirring, and then separated from the boric acid solution by filtration for example. Thus, all the particles of copper powder are covered with a thin layer of the boric acid solution adhered thereto.

Then, the copper powder separated from the boric acid solution is heated to a temperature ranging from 50° to 260° C. in the air and maintained at that temperature for about 5 to 60 minutes, preferably, 10 to 20 minutes. During heating, the solvent in the thin layer of the boric acid solution is removed by evaporation or combustion, while boric acid ($H_3BO_3$) is decomposed to metaboric acid ($HBO_2$) at 100° C. and to tetraboric acid ($H_2B_4O_7$) at 140° C. Thus, there are obtained copper powder of particles which are covered with a coating of boric acid, metaboric acid and/or tetraboric acid. However, if the copper powder is heated to a temperature exceeding 300° C., boric acid is decomposed to boron oxide ($B_2O_3$), thus making it impossible to protect the copper powder from oxidation. For this reason, the heating temperature of the copper power covered with the boric acid solution is limited to less than 300° C., preferably, not more than 260° C.

A thickness of the coating on the copper particles is determined by a concentration of boric acid in the solution and/or a combination of two or more solvents, while a composition of the coating on the copper powder is determined by the maximum temperature at which the coated copper powder is heated.

The thus treated copper powder is generally used as a conductive material for conductive pastes. Baking or firing conditions of the conductive paste may be determined optionally by a suitable combination of the solvent to be used, the concentration of boric acid in the solution, and the heating temperature of the copper powder with the thin layer of the boric acid solution.

The above and other objects, features and advantages of the present invention will become further apparent from the following preferred examples thereof.

EXAMPLE 1

There was prepared a boric acid solution containing boric acid in a concentration of 10 wt % by dissolving boric acid in methyl alcohol. Then, 100 g of copper powder with particle size ranging from 0.1 to 5 μm was placed in 700 ml of the boric acid solution, stirred for about 1 hour, and then separated from the solution by filtration. The thus treated copper powder was then heated in air at a temperature of 150° to 200° C. for 10 minutes to produce copper powder with a coating of boron compound, specimen A.

Separate from the above, using boric acid solutions containing boric acid with a concentration of 5 mol% or 15 mol%, there were respectively prepared copper powders with a coating of boron compound, B and C, in the same manner as above.

Using the resultant specimens A, B and C, there were respectively prepared conductive paste A, B and C by mixing 80 g of each copper powder A, B or C with 7 g of lead borosilicate glass frit and 13 g of organic vehicle composed of 8 wt % of ethyl cellulose and 92 wt % of α-terpineol. Reference symbols for the paste correspond to those for the boron coated copper paste.

For comparison, there was prepared conductive paste D in the same manner as above, using bare copper podwer which is free from oxidation but is never treated by the above anti-oxidizing process.

Each conductive paste was applied on a substrate of alumina by screen process printing, dried at 150° C. for 10 minutes, and then baked at 600° C. for 10 minutes in an inert atmosphere having an oxygen concentration as shown in Table 1 to form conductive patterns on the alumina substrate. The baking treatment is carried out by heating the printed substrate at the rate of 20° C./minute, maintaining it at 600° C. for 10 minutes, and then cooling it to room temperature at the rate of 20° C./minute.

For each resultant conductive patterns on the substrate, the solderability was evaluated by visual inspection. Results are shown in Table 1 together with the sheet resistivity of the conductive patterns made from conductive paste A, B and C.

TABLE 1

| | $O_2$ concentration (ppm) | | | | Sheet resistance (mΩ/sq) |
|---|---|---|---|---|---|
| Paste | 50 | 300 | 600 | 900 | |
| A | Excellent | Excellent | Excellent | Good | 1–3 |
| B | Excellent | Excellent | Good | Bad | 1–3 |
| C | Excellent | Excellent | Excellent | Excellent | 1–3 |
| D | Bad | Bad | Bad | Bad | — |

From the results shown in Table 1, it will be seen that all the conductive patterns made from the conductive paste D containing bare copper powder are poor in solderability regardless of changes of the oxygen concentrations.

In contrast therewith, the conductive patterns made from the conductive paste A, B or C possess considerably improved solderability. From the data for the conductive paste A, B and C, it will be seen that the solderability of the conductive patterns is improved with increase in concentration of boric acid contained in the boric acid solution used for preparation of the boron-coated copper powder.

Further, the conductive patterns made from the conductive paste A, B or C possess low sheet resistivity of 1 to 3 mΩ/square sufficient for practical use.

Separate from the above, the boron-coated copper powder A was left to stand for 1 year in the air. No oxidation was detected from the particles of the boron-coated copper powder A even after 1 year.

Although the present invention has been fully described in connection with the preferred embodiments thereof, it is to be noted that various changes and modifications are apparent to those skilled in the art. Such changes and modifications are to be understood as included within the scope of the present invention as defined by the appended claims unless they depart therefrom.

What is claims is:

1. A method for anti-oxidizing treatment of copper powder, comprising the steps of:

immersing copper powder in a solution containing boric acid;

separating the resultant copper powder from the solution; and heating said copper powder covered with a layer of said solution at a temperature of 50° to 260° C.

2. The method according to claim 1 wherein said copper powder is free from oxidation and has particle size of 0.1 to 5 μm.

3. The method according to claim 1 wherein said solution is composed of an organic solvent and boric acid dissolved therein.

4. The method according to claim 3 wherein said organic solvent is an organic compound having one or more hydroxy groups in molecule thereof.

5. A method according to claim 4 wherein said organic solvent is a monohydric or polyhydric alcohol.

6. A method according to claim 1 wherein the copper powder is immersed in the solution for 0.1–10 hours and wherein said heating said copper powder is for 5–60 minutes.

7. The method according to cliam 6 wherein said heating of said copper powder is for 10–20 minutes.

* * * * *